US007708395B2

(12) United States Patent
Takimoto

(10) Patent No.: US 7,708,395 B2
(45) Date of Patent: May 4, 2010

(54) LIQUID CONTAINER WITH WIRELESS COMMUNICATION ANTENNAS

(75) Inventor: Masafumi Takimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 313 days.

(21) Appl. No.: 11/770,380

(22) Filed: Jun. 28, 2007

(65) Prior Publication Data

US 2008/0007578 A1 Jan. 10, 2008

(30) Foreign Application Priority Data

Jul. 6, 2006 (JP) ..... 2006-187001

(51) Int. Cl.
*B41J 2/175* (2006.01)
*G08B 13/14* (2006.01)
*B41J 2/195* (2006.01)

(52) U.S. Cl. ..... 347/86; 347/7; 340/572.7

(58) Field of Classification Search ..... 347/86
See application file for complete search history.

(56) References Cited

U.S. PATENT DOCUMENTS

| | | | | |
|---|---|---|---|---|
| 6,402,310 | B1 | 6/2002 | Maeda et al. | 347/87 |
| 6,585,345 | B2 | 7/2003 | Kosugi | 347/19 |
| 2003/0214546 | A1 | 11/2003 | Hatasa et al. | 347/19 |
| 2004/0114002 | A1* | 6/2004 | Kosugi et al. | 347/86 |
| 2004/0119637 | A1 | 6/2004 | Angal et al. | 342/124 |
| 2004/0239706 | A1 | 12/2004 | Kawakami | 347/7 |
| 2005/0012766 | A1* | 1/2005 | Fukano et al. | 347/7 |
| 2007/0222610 | A1* | 9/2007 | Tagato | 340/572.7 |
| 2008/0036827 | A1* | 2/2008 | Anderson et al. | 347/86 |

FOREIGN PATENT DOCUMENTS

| | | |
|---|---|---|
| EP | 1647406 | 4/2006 |
| JP | 10-255011 | 9/1998 |
| JP | 2002-234192 | 8/2002 |
| JP | 2003-300359 | 10/2003 |
| JP | 2004-338395 | 12/2004 |

OTHER PUBLICATIONS

Chinese Office Action dated Apr. 17, 2009 from corresponding Chinese Application No. 200710128109.3, and English language translation thereof.
Chinese Office Action dated Dec. 11, 2009 from corresponding Chinese Application No 200710128109.3, and English language translation thereof.

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

A liquid container having a memory for storing data. The memory includes a rewritable region from which the data is readable and in which the data is rewritable, and a read only region from which the data is readable and in which the data is unwritable. A first circuit overwrites the data and reads the data from the rewritable region, and a second circuit reads the data from the read only region. A first antenna is connected with the first circuit, and a second antenna is connected with the second circuit. A protecting member protects the first antenna during transportation of the liquid container and exposes the first antenna and the second antenna in use.

10 Claims, 9 Drawing Sheets

LIQUID CONTAINER WITH WIRELESS COMMUNICATION ANTENNAS

FIELD OF THE INVENTION AND RELATED ART

The present invention relates to a recording apparatus which makes a record on recording medium by jetting liquid (which hereafter may be referred to as ink), which contains, or does not contain, coloring agents, etc. It also relates to a liquid container mountable in the main assembly of the abovementioned recording apparatus.

A recording apparatus which records by jetting ink has a recording head which jets ink droplets. It causes the recording head to jet ink while moving the recording head and recording medium relative to each other. It is capable of forming an image on various recording media, for example, paper, fabric, etc. An ink jet recording apparatus is a nonimpact recording apparatus, that is, a recording apparatus which does not impact recording medium. Thus, it is low in recording noise. Further, it can be designed to be small in size, and also, can be easily designed to be used with multiple inks, different in colors, to form a color image. In other words, an ink jet recording apparatus has many advantages such as the above described ones. A serial ink jet recording apparatus is one of the various types of ink jet recording apparatus. It records by reciprocally moving its recording head, relative to recording medium, in the direction intersectional (perpendicular) to the direction in which the recording medium is conveyed. It employs a small and inexpensive recording head, and yet, is capable of forming a high quality image. Presently, therefore, it is widely used in the field of an electronic apparatus, such as a printer, a copying machine, a facsimile machine, etc., and also, in the field of industrial machinery.

There have been known various recording heads which are employable as the recording head for an ink jet recording apparatus. Some of them have electro-thermal transducers (heaters) or electro-mechanical transducers (piezoelectric elements). Among them, the recording heads which use electro-thermal transducers to jet ink are advantageous in that they can record at a high level of resolution, because their ink jetting orifices can be arranged at a very high level of density, and also, that they can be easily designed to be compact.

Ink jet recording heads have an ink jetting portion and an ink container portion. In the case of the ink jet recording heads of the cartridge type, the ink jetting portion and ink container portion are integral. There are also ink jet recording heads, the ink jetting portion and ink container portion of which are independent from each other; in the case of these ink jet recording heads, the ink container portion is an independent ink container, and is removably mountable in an ink container holder (or holder portion of ink jet recording head).

In either case, if a recording head is activated to jet ink when ink cannot be supplied to the head (for example, there is no ink in ink container), it is possible that the ink jetting portion of the recording head will be damaged. Thus, an ink jet recording apparatus has to be designed so that the amount of ink in the ink container is accurately known to ensure that the recording head is activated only when ink can be supplied to the recording head. Further, even when an ink jet recording cartridge or an ink container, which is not fresh, is mounted into the recording apparatus, the amount of ink in the ink container has to be accurately known. Therefore, it is necessary that the information regarding the amount of ink in an ink jet recording cartridge or an ink container is held by the cartridge or ink container itself.

In recent years, it has become a common practice to make an ink jet recording cartridge or an ink container hold information, such as trade name, regarding the cartridge or ink container, in order to improve the distribution of cartridges or ink containers, that is, in order to prevent overstocking, to know the fast selling items, and to simplify the process of taking inventory. Thus, it is common practice to use the information carried by each cartridge or each ink container, in order to manage each of the cartridges and ink containers.

Thus, in recent years, a wireless tag based on RFID (Radio Frequency Identification) has come to be widely used in response to the abovementioned demand in the field of commodity management. For example, technologies for providing each recording head with a wireless tag have been put to practical use. One of these types of wireless tag has been known to be provided with an IC chip, as a data storage, and to have an antenna which is in connection to the IC chip, and in which electric power is generated by electromagnetic induction by an external device.

Japanese Laid-open Patent Application 2002-234192 discloses an ink cartridge provided with a nonvolatile memory and an antenna. In the case of this ink cartridge, the data sent from the main assembly of the ink jet recording apparatus through the antenna of the main assembly are written into the nonvolatile memory of the ink cartridge.

Japanese Laid-open Patent Application H10-255011 discloses a noncontact IC card provided with a sealing member capable of blocking electromagnetic wave. In the case of this noncontact IC card, the antenna with which the IC cartridge is provided is covered with the protective member so that the IC is not allowed to communicate at all as long as the ink container having the IC card remains in the brand-new condition.

Japanese Laid-open Patent Application 2003-300359 discloses a label provided with an adhesive layer and an antenna. More specifically, this patent application discloses a technology which makes it possible to change the communication range of the antenna by breaking the label so that the communication range which the antenna has while the ink cartridge, to which the antenna belongs, is in its distribution network, can be made different from the communication range which the antenna has while the ink container is in a recording apparatus, that is, after it is put to use for the first time.

Japanese Laid-open Patent Application 2004-338395 discloses a cartridge provided with: an ink amount detecting portion; a nonvolatile memory; an electric power generating portion; an information storage portion whose structural components are a high frequency wave receiving portion, etc.; and an antenna. The cartridge is also provided with a dielectric sheet which can be peeled away. This sheet is for preventing the occurrence of electrostatic discharge between the information storage portion and antenna portion. Further, in order to prevent the information in the information storage portion from being erased, the peelable sheet is enabled to block ultraviolet rays.

In the case of the technology disclosed in Japanese Laid-open Patent Application 2002-234192, the antenna can be easily excited by a magnetic field generated by an external source. Therefore, it is possible that the important data in the nonvolatile memory will be altered.

In the case of the noncontact IC card disclosed in Japanese Laid-open Patent Application H10-255011, the data in the IC card cannot be accessed during cartridge distribution, creating the problem that it is impossible to efficiently perform such tasks as inventory management, pin-pointing fast selling items, simplifying the inventory taking process, which are related to commodity distribution.

In the case of the noncontact IC card disclosed in both Japanese Laid-open Patent Applications 2003-300359 and 2004-338395, it is provided with an antenna portion and a re-writable information storage portion. In both cases, the data in the information storage portion are physically prevented from being altered. That is, the information storage portion and/or antenna portion is provided with a dielectric sealing member, which is pasted thereto to prevent the information from being altered.

SUMMARY OF THE INVENTION

According to the present invention which relates to a liquid container capable of exchanging data with a recording apparatus in a noncontact fashion, a liquid container is provided with a circuit capable of only reading the internal information, and a circuit capable of both reading the information and re-writing (altering) the information, and the two circuits are independent from each other. The primary object of the present invention is to provide an inexpensive liquid container structured so that when the ink container is in the distribution system, the data it carries can only be read, whereas when the ink container is in use, not only can the data be read, but also, can be re-written (altered).

According to an aspect of the present invention, there is provided a liquid container comprising a communicating means capable of non-contact communication with an external sending and receiving portion; storing means for storing data, wherein said storing means includes a rewritable region from which the data is readable and in which the data is rewritable and a writing-prevented region in which the data is readable and in which the data is unwritable, wherein said communicating means includes a overwriting circuit for overwriting the data in and for reading the data from said rewritable region; a first antenna provided in said communicating means and connected with said overwriting circuit a reading circuit for reading the data from said overwriting non-permission region; and a second antenna provided in said communicating means and connected with said reading circuit, and wherein said overwriting circuit and said reading circuit are constituted by respective electric circuits which are independent from each other.

According to another aspect of the present invention, there is provided a recording apparatus to which a liquid container including a sending and receiving portion, communicating means capable of non-contact communication and storing means for storing data is detachably mountable, recording device comprising:

said storing means including a rewritable region from which the data is readable and in which the data is rewritable and a writing-prevented region in which the data is readable and in which the data is unwritable, said communicating means including an overwriting circuit for overwriting the data in and for reading the data from said rewritable region; a first antenna provided in said communicating means and connected with said overwriting circuit a reading circuit for reading the data from said overwriting non-permission region; a second antenna provided in said communicating means and connected with said reading circuit; wherein said overwriting circuit and said reading circuit are constituted by respective electric circuits which are independent from each other, so that sending and receiving portion is capable of the non-contact communication with the antennas associated with said electric circuits severally.

According to the present invention, an ink container is provided with first and second antennas. The first antenna is in connection to the re-writing circuit which is capable of re-writing the data in the re-writable area, as well as reading the data, and is covered with a protective member which is not to be removed until the ink container is used for the first time. Therefore, the problem that the data stored in the re-writable area are altered before the cartridge is used for the first time, for example while the cartridge is in the distribution system, can be avoided. Further, the second antenna is connected to the reading circuit for reading the data in the read-only area, and is left in the state in which it is allowed to communicate. Therefore, the data in the read-only area can be read during the distribution of the ink container.

Further, the protective member is to be removed before the ink container is mounted into a recording apparatus. Therefore, while the ink container is in the recording apparatus, noncontact communication is possible, with no problem, between the ink container and the main assembly of the recording apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described in detail with reference to the appended drawings.

Figure 1:
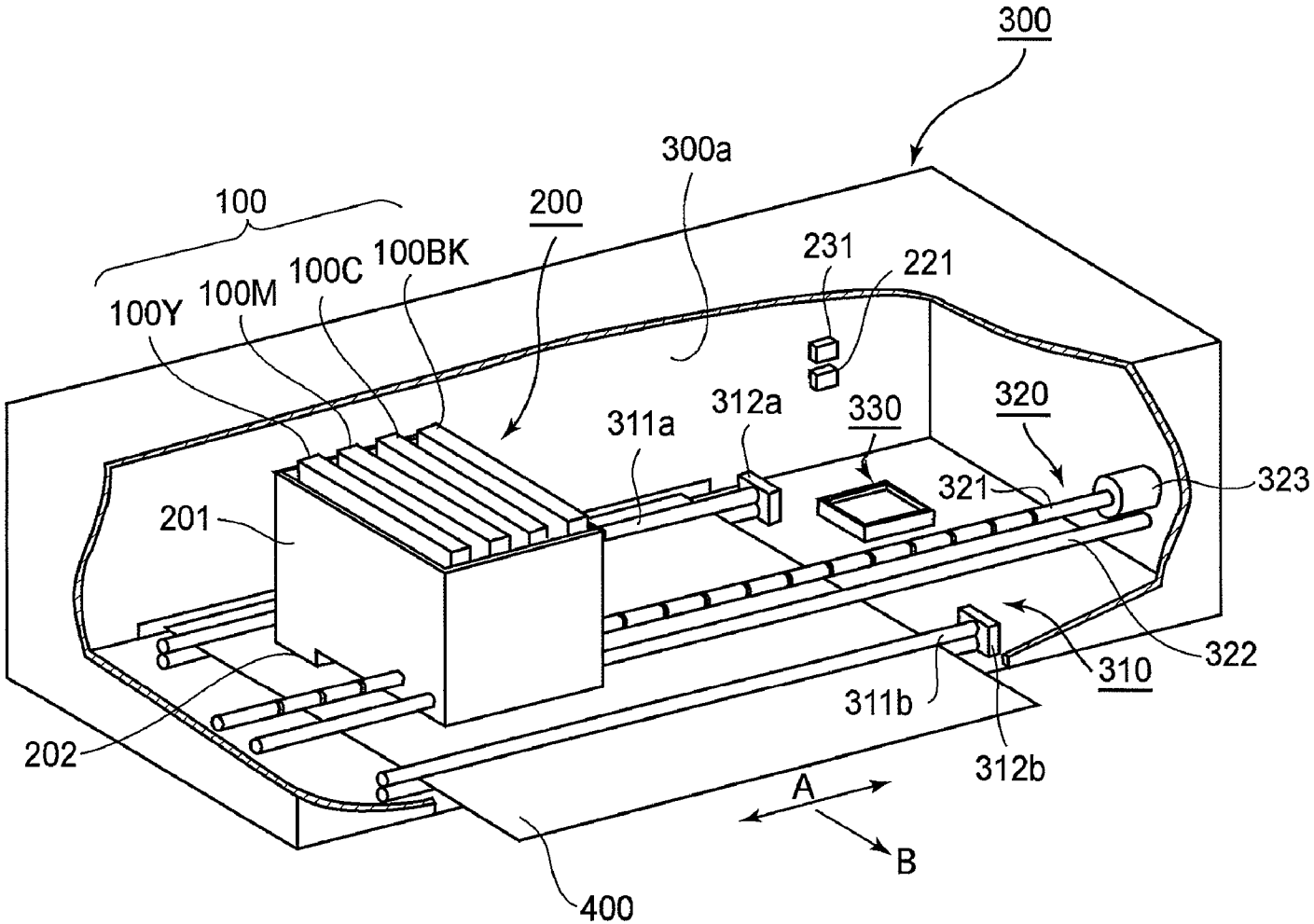
FIG. 1 is a partially cutaway perspective view of a typical ink jet recording apparatus in which a liquid container in accordance with the present invention is mountable, and shows the structure of the apparatus.

FIG. 1 is a partially cutaway perspective view of a typical ink jet recording apparatus in which a liquid container in accordance with the present invention is mountable, and shows the internal structure of the apparatus.

Referring to FIG. 1, an ink jet recording apparatus 300 (which hereafter will be referred to simply as recording apparatus) has a conveying mechanism 310 for conveying a recording medium 400 in the direction indicated by an arrow mark B. It also has a moving mechanism 320 for reciprocally moving the recording head 200 in the direction intersectional (perpendicular) to the direction in which the recording medium 400 is conveyed.

The conveying mechanism 310, that is, the recording medium conveying mechanism, has a pair of roller units 311*a* and 311*b*, and a pair of driving portions 312*a* and 312*b*, respectively. Each roller unit 311 is made up of a pair of rollers which are juxtaposed in parallel and in contact with each other. Each driving portion is made up of a motor for driving the rollers, etc. The driving portions 312*a* and 312*b* intermittently rotate the roller units 311*a* and 311*b* in order to intermittently convey the recording medium 400 in the direction B (secondary scan direction) by a preset distance, while keeping the recording medium 400 between the two rollers of each unit.

The moving mechanism 320, that is, the recording head moving mechanism, has a guide shaft 322 which guides the recording head 200 in the primary scan direction (indicated by arrow mark A). It also has a drive shaft 321, and a motor 323. The drive shaft 321 is parallel to the guide shaft 322, and the motor 323 rotates the drive shaft 321. The recording head 200 is provided with an unshown nut, which is perforated with a threaded hole. The nut is fitted around the drive shaft 321 so that its threads engage with the threads of the drive shaft 321. Thus, as the drive shaft 321 is rotated forward or in reverse by the motor 323, the recording head 200 is moved forward or backward along the guide shaft 322 and drive shaft 321.

In this embodiment, the recording head 200 is provided with an ink container holder 201, and an ink jetting portion 202. The ink jetting portion 202 is solidly fixed to the ink container holder 201 so that it directly faces the recording medium 400. It is provided with multiple ink jetting orifices, which are arranged in multiple rows. It records an image by jetting ink droplets in response to the ink jetting signals sent from the control system, which will be described later. Also in this embodiment, the ink jetting portion 202, which is to be mounted into the ink container holder 201, is provided with four ink jetting portions which jet four inks different in color, that is, yellow, magenta, cyan, and black inks, one for one. The ink container holder 201 is structured so that the four ink containers, which are independent from each other and hold the abovementioned four inks one for one, can be removably mounted in the ink container holder 201. Referring again to FIG. 1, designated by referential characters 100Y, 100M, 100C, and 100Bk are ink contains which are for containing yellow ink, magenta ink, cyan ink, and black ink, respectively.

The recording apparatus 300 is provided with a recovery portion 330, which is for maintaining the ink jetting performance of the ink jetting orifices of the recording head 200. The recovery portion 330 is located in the adjacencies of one end of the range across which the recording head 200 is moved by the moving mechanism 320. Further, the recovery portion 330 is located a preset distance away from the path of the recording medium 400. In this embodiment, the position of the recovery portion 330 corresponds to the home position of the recording head 200. The recovery portion wipes the surface of the recording head 200, which has the opening of each ink jetting orifice. The recovery portion makes the recording head 200 discharge the body of ink, which is in the outward end of each ink jetting orifice, and which has increased in viscosity.

The recording apparatus 300 is also provided with a pair of antennas 221 and 231, which are located next to the home position of the recording head 200. The antennas 221 and 231 make it possible for information to be exchanged between the main assembly of the recording apparatus 300 and each ink container 100.

Figure 2A:
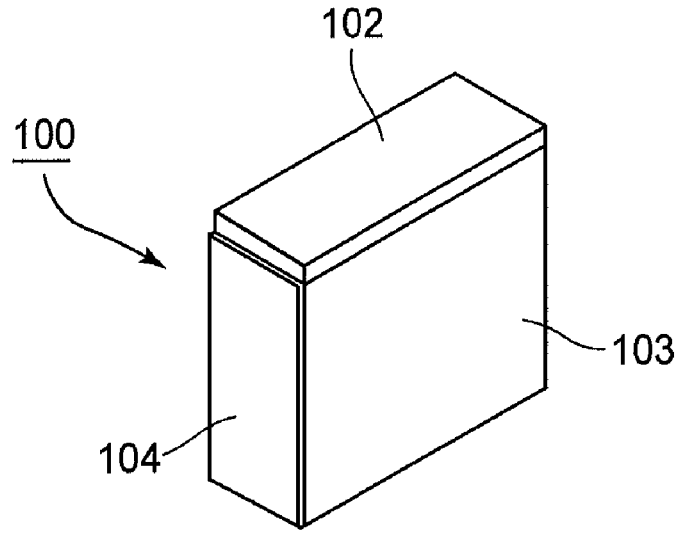
FIG. 2(A) is an external perspective view of an ink container in accordance with the present invention.
Figure 2B:
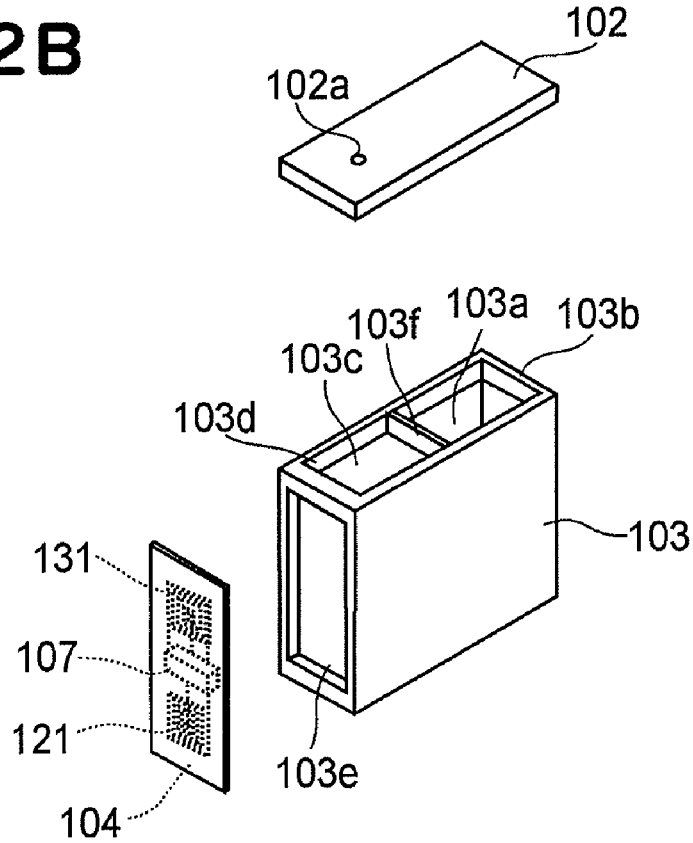
FIG. 2(B) is an exploded perspective view of the ink container in accordance with the present invention.

FIGS. 2A and 2B are an external perspective view of the entirety of the ink container 100 in accordance with the present invention, and an exploded external perspective view of the entirety of the ink container in accordance with the present invention, respectively.

The ink container 100 is made up of a lid 102, a container proper 103 (liquid storage portion), and an antenna chip 104.

The ink container proper 103 has an ink chamber 103*b*, in which ink 103*a* is stored, and an absorbent member chamber 103*d*, in which an absorbent member 103*c* formed of a porous substance is stored. The ink chamber 103*b* and absorbent member chamber 103*d* are separated by a partitioning wall 103*f*. The bottom end of the partitioning wall 103*f* is provided with an unshown through hole, through which the two chambers are in connection with each other. The ink in the ink chamber 103*b* permeates into a part of the ink absorbent member 103*c* in the absorbent member chamber 103*d* through this through hole. The ink container proper 103 and lid 102 are formed of a resin such as polypropylene resin. The lid 102 is attached to the container proper 103 so that the openings of the absorbent member chamber 103*d* and the opening of the ink chamber 103*b*, which are at the top of the container proper 103, can be sealed by closing the lid 102 against the container proper 103. As the means for attaching the lid 102 the container proper 103, the ultrasonic welding or the like is used.

The lid 102 is provided with an air vent 102*a*, through which the internal space of the absorbent member chamber 103*d* is in connection to the outside. Further, the antenna chip 104 is solidly attached to the outward surface of one of the lateral walls of the ink container proper 103.

Figure 3A:
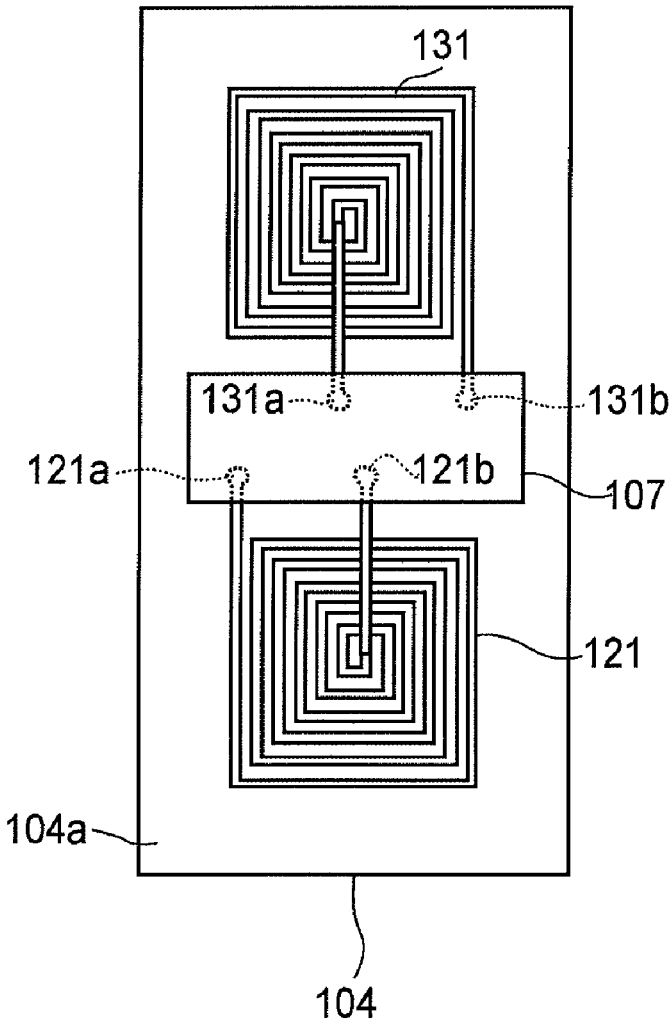
FIG. 3(A) is a plan view of the antenna chip of the ink container in the preferred embodiment of the present invention.
Figure 3B:
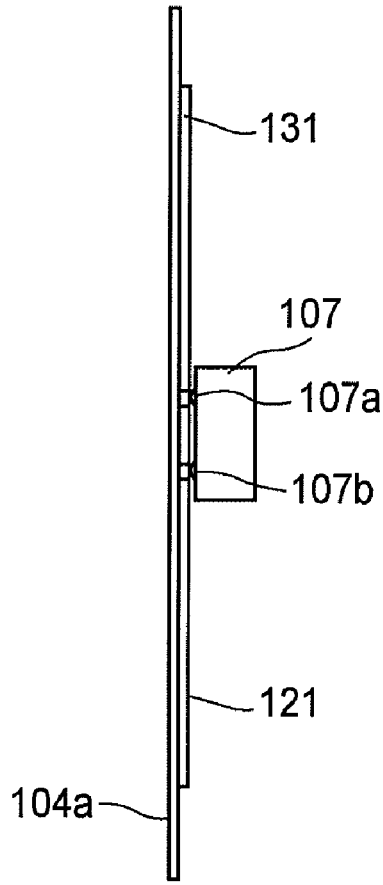
FIG. 3(B) is a side view of the antenna chip of the ink container in the preferred embodiment of the present invention.

FIG. 3A is a plan view of the antenna chip 104 with which the ink container 100 in this embodiment is provided, and FIG. 3B is a side view of the antenna chip 104.

The frequency range (or frequency) of the abovementioned RFID is: no higher than 135 kHz, 13.56 MHz, 800-900 MHz, or 2.45 GHz. The frequency used by the antenna chip 104 in this embodiment of the present invention is 13.56 MHz. The antenna is flat.

Referring to FIG. 3A, the antenna chip 104 is made up of a substrate 104*a* and a pair of antennas 131 (first antenna) and 121 (second antenna). The substrate 104*a* is formed of PET film. The antennas 131 and 121 are on the top surface of the substrate 104*a*. They are spiral and are formed of aluminum. The antenna 121 is provided with a pair of terminals 121*a* and 121*b*, and the antenna 131 is provided with a pair terminals 131*a* and 131*b*. These terminals 121*a*, 121*b*, 131*a*, and 131*b* are in connection to the terminals 107*a* and 107*b* of an antenna driving element 107. As the means for electrically conductively attaching the terminals of the antennas to the terminals of the antenna driving element, ACF (Anisotropic Conductive Film), ball-grid, or the like, can be used. The antennas 121 and 131 are symmetrically positioned relative to each other, with reference to the center of the antenna driving element 107.

The antenna chip 104 is attached to the container proper 103 so that the antenna 131 is positioned near the lid 102 and the antenna driving element 107 is positioned in a recess 103*e* (FIG. 2B) of the container proper 103. For this attachment, ultrasonic welding, for example, can be used.

In terms of overall shape, the ink container 100 in this embodiment is roughly in the form of a rectangular parallelepiped. The bottom wall of the absorbent member chamber 103*d* is provided with an ink outlet 108 (FIG. 5), which is connected to the recording head 200 as the ink container 100 is attached to the recording head 200.

Figure 5:
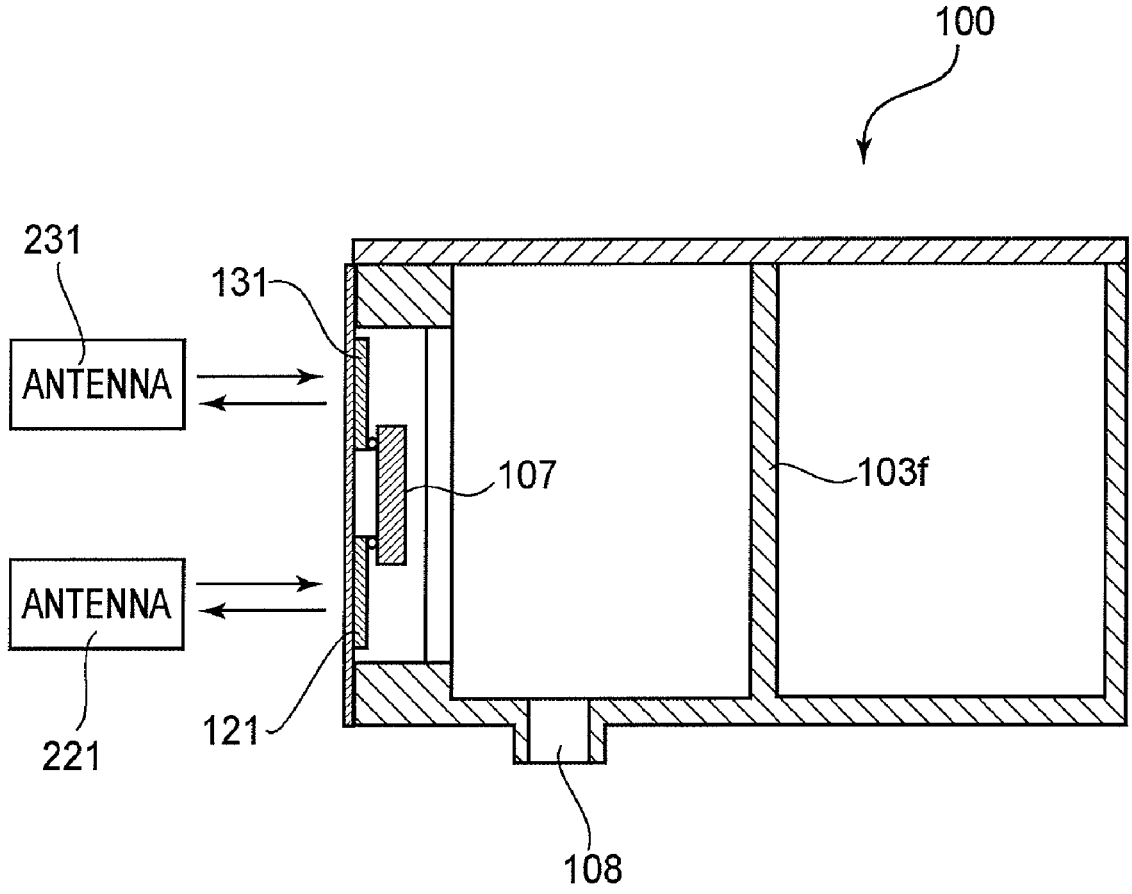
FIG. 5 is the combination of a schematic side view of the antennas of the recording apparatus in the preferred embodiment, and a schematic sectional view of the ink container in the preferred embodiment, and shows the relationship between the antennas of the recording apparatus and the antennas of the ink container after mounting of the ink container into the recording head.

As the ink container 100 is attached to the recording head 200, the antenna chip 104 of the ink container 100 is positioned so that it faces the inward surface 300*a* of the recording apparatus 300, with the presence of a preset gap. The recording apparatus 300 is provided with a pair of antennas 221 and 231, which are on the inward surface 300*a* of the recording apparatus 300, being in the vertical alignment. Thus, as the recording head 200 is moved to the home position of the recording head 200 after the mounting of the ink containers 100, different in the color of the inks they contains, into the recording head 200, the pairs of antennas 121 and 131, which the ink containers 100 have one for one, sequentially move along the pair of antennas 221 and 231 of the main assembly of the recording apparatus 300. FIG. 5 shows the positional relationship among the antennas 221 and 231 of the main assembly of the recording head 300, and the antennas 121 and 131 of each ink container 100, after the mounting of the ink container into the recording head 200.

Next, referring to FIGS. 6A and 6B which are an external perspective view of the ink container 100, and an external perspective view of the sealing member 101, respectively, the state of the ink container 100, in which the ink container 100 is kept during its distribution, and the sealing member 101 which is kept attached to the ink container 100 during the shipment of the ink container 100, will be described.

Figure 6A:
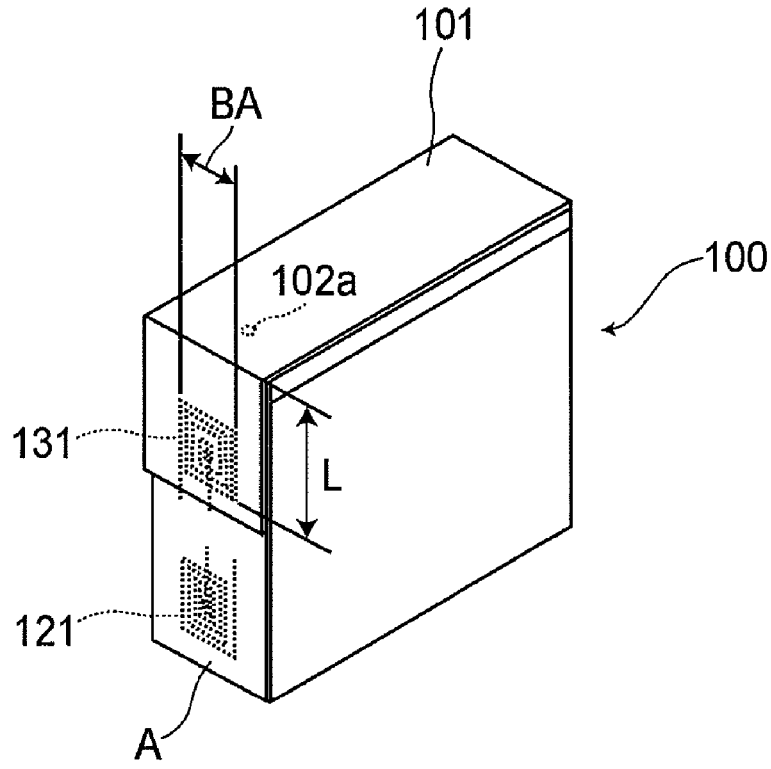
FIG. 6A is a perspective view of the ink container in the preferred embodiment, showing the state in which the ink container is during its distribution.
Figure 6B:
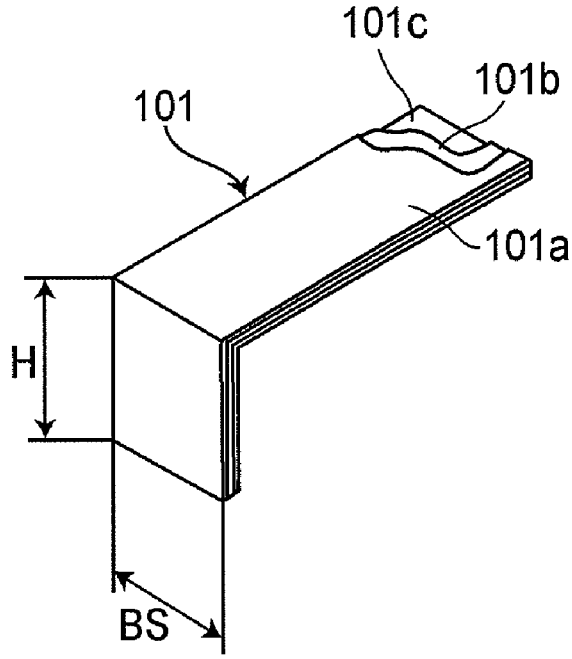
FIG. 6B is a perspective view of the sealing member which keeps the ink container, shown in FIG. 6A, sealed during the distribution of the ink container.

Referring to FIG. 6A, the ink container 100 in this embodiment is provided with the sealing member 101 (protective member), which is pasted to the ink container 100 during the manufacture of the ink container and is left on the ink container 100 during the distribution of the ink container 100 (until container is put to use for the first time). The sealing member 101 is made up of a piece of resin film 101*a*, a metallic foil layer 101*b*, and an adhesive layer 10*c*. The resin film 101*a* serves as the substrate of the sealing member 101. The metallic foil layer 101*b* is on the bottom surface of the resin film 101*a*, and the adhesive layer 101*c* is on the bottom surface of the metallic layer 101*b*. As the resin used as the material for the resin film 101*a*, PET resin, for example, can be used. As the metallic foil used as the material for the metallic foil layer 101*b*, it is desired to use aluminum foil.

The design of the sealing member 101 is such that as the sealing member 101 is adhered to the ink container 100 by its adhesive layer 10*c*, not only does it cover the air vent 102*a* which the lid 102 of the ink container 100 has, but also, it covers the entirety of the antenna 131, that is, one of the two antennas of the ink container 100, which are on the outward surface A of the ink container 100. Referring to FIGS. 6A and 6B, represented by a referential character BA is the width of the antennal 131, and represented by a referential character BS is the width of the sealing member 101. Represented by a referential character H is the length of the portion of the sealing member 101, which is pasted to the lateral surface A of the ink container 100, and represented by a referential character L is the distance between the bottom end of the antenna 131 and the top edge of the lateral surface A. The ink container 100 and sealing member 101 are designed so that their dimensions satisfy: BS>BA, and H>L. The sealing member 101 is formed so that the portion of the sealing member 101, which is to be pasted to the lateral surface A of the ink container 100 is perpendicular to the portion of the sealing member 101, which is to be pasted to the lid 102, as shown in FIG. 6B. Forming the sealing member 101 as described above is desirable from the standpoint of satisfactorily pasting the sealing member 101 to the ink container 100.

Pasting the sealing member 101 to the ink container 100 as described above eliminates the problem that ink leaks through the air vent 102*a* of the ink container 100 during the distribution of the ink container 100. The sealing member 101 has the metallic foil layer 101*a*. Thus, while the antenna 131 remains covered with the sealing member 101, it remains blocked from the high frequency magnetic fields generated by external sources.

Next, referring to FIG. 4 which is a block diagram, the control system and antenna driving element 107 of the recording apparatus 300 will be described regarding their circuit structures.

Figure 4:
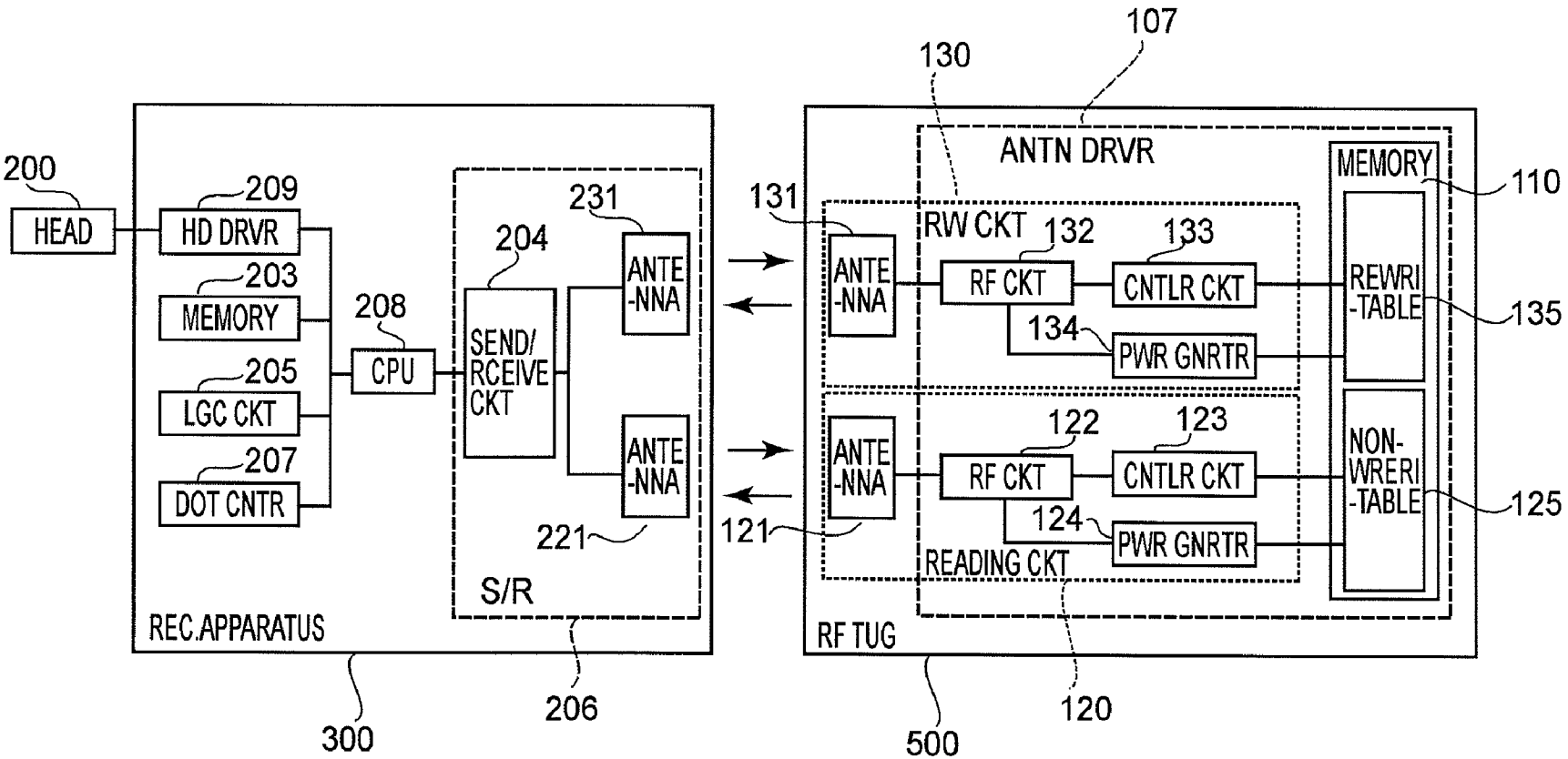
FIG. 4 is a block diagram of the combination of the control system circuit and antenna driver circuit, in the preferred embodiment.

Referring to FIG. 4, the recording apparatus 300 is provided with the aforementioned antennas 221 and 231 (which are on the inward surface of one of the lateral walls of recording apparatus), and a transmitting-and-receiving portion 206 which has a transmitting-and-receiving circuit 204 connected to the antennas 221 and 231. The transmitting-and-receiving circuit 204 outputs signals, such as the signal for accessing the data in the antenna driving element 107 of the ink container 100, in response to a command from a CPU 208 which controls the recording apparatus 300. The transmitting-and-receiving circuit 204 is structured so that it outputs (transmits) the signals through the antennas 231 and 221 by modulating the carrier wave, which has a preset frequency, with data the signals. The recording apparatus 300 is also provided with a head driving portion 209, which is in the recording apparatus 300 and drives the energy generating elements (for example, heaters or piezoelectric elements) with which the recording head 200 is provided to jet ink through its ink jetting orifices. Also located in the recording apparatus 300 are: a storage portion 203 for storing various data; a logic circuit portion 205 which performs computational operations, which will be described later; a dot counter 207 which counts the number of ink dots formed by the recording head 200; etc. Further, various driving circuits for driving motors, displays, etc., are also located in the recording apparatus 300, but, they are not shown in FIG. 4.

The antenna driving element 107, with which the ink container 100 is provided, has: a memory 110; a reading circuit 120 which reads the data in the memory 110; and a reading-and-writing circuit 130 which re-writes (alters) or reads the data in the memory 110. The writing-and-reading circuit 130 and reading circuit 120 are independent from each other. That is, the writing-and-reading circuit 130 is made up of the antenna 131, an RF circuit portion 132 (high frequency circuit portion), a control circuit portion 133, and an electric power generating portion 134. The reading circuit 120 is made up of the antenna 121, an RF circuit portion 122 (high frequency circuit portion), a control circuit portion 123, and an electric power generating portion 124.

The memory 110 is a nonvolatile memory, and has a re-writable area 135, that is, an area which allows the data therein to be read or altered, and a read-only area 125, that is, an area which allows the data therein to be read, but, does not allow the data therein to be altered. The re-writable area 135 is connected to the writing circuit 130, whereas the read-only area 125 is connected to the reading circuit 120.

Next, the working of the antenna driving element 107 will be described with reference to the writing circuit 130.

A high frequency wave signal generated by the transmitting-and-receiving circuit 204 induces a high frequency magnetic field through the antenna 231. As this high frequency magnetic field is generated, a high frequency signal is induced in the antenna 131. The RF circuit portion 132 of the ink container 100 extracts a referential clock signal, which constitutes the operational reference for the RF circuit portion 132 itself and control circuit portion 133. At the same time, the carrier wave transmitted, while being modulated with the data signals by the transmitting-and-receiving circuit 204, is demodulated to extract the data signals. The electric power generating portion 134 rectifies the high frequency signals induced in the antenna 131 in order to generate DC electric power for driving the various circuits in the antenna driving element 107. The control circuit portion 133 controls the operation of the RF circuit portion 132, the process of reading the data in the re-writable area 135 of the memory 110, and the process of writing data into the re-writable area 135. The read data are modulated again onto the high frequency carrier wave by the RF circuit portion 132, and are transmitted to the transmitting-and-receiving portion 206 through the antenna 131.

The data in the read-only area 125 are readable only when the antenna 121 is excited, as are the data in the re-writable area 135 only when the antenna 131 is excited. The data read by the reading circuit 120 are transmitted to the transmitting-and-receiving portion 206.

The re-writable area 135 holds the data regarding the remaining amount of ink. The data are read by the recording apparatus 300 through the above described processes, and the amount of remaining ink is displayed on an unshown display device or the like to inform a user of the remaining amount of ink. Since the re-writable area of the memory 110 of the ink container 100 holds the amount of the remaining ink as described above, the amount of ink in the ink container 100 can be accurately known even if an ink container (100) structured as described above is moved from a recording apparatus structured as described above to another recording apparatus structured as described above. Further, the read-only area of the memory 110 of the ink container 100 holds data, such as the container ID, the year, month, day, minute, second of the container production, the location of the container production, etc.

Next, referring to FIGS. 4 and 5, the working of the recording apparatus 300 will be described.

Prior to the distribution of the ink container 100, the sealing member 101 is pasted to the ink container to prevent the ink 103*a* from leaking from the ink container 100, to prevent the evaporative ink ingredients from evaporating, and also, to protect the data in the re-writable area 135. A user is to peel the sealing member 101 away from the ink container 100 immediately before the user mounts the ink container 100 into the preset location in the recording apparatus 300.

As the recording apparatus 300 is turned on when the ink container 100 is in the apparatus 300, or as soon as the ink container 100 in the recording apparatus 300 is replaced with another ink container (100), the recording apparatus 300 first performs the operation for obtaining and confirming the ID information. This operation is carried out as the recording head 200 is moved in the adjacencies of its home position in the recording apparatus 300. That is, the recording head 200 is positioned so that the antenna 121 and 131 of the ink container 100 directly face the antennas 221 and 231 on the inward surface 300*a* of the recording apparatus 300. In this embodiment, the recording apparatus 300 employs four ink containers 100 (100Y, 100M, 100C, and 100Bk). Therefore, the recording head 200 is moved so that the antennas 121 and 131 of the ink container 100Y, the antennas 121 and 131 of the ink container 100M, the antennas 121 and 131 of the ink container 100C, and the antennas 121 and 131 of the ink container 100Bk sequentially oppose the antennas 221 and 231.

As the antennas 121 and 131 of each ink container 100 directly face the antennas 221 and 231 of the recording apparatus 300, the recording apparatus 300 excites the antenna 221 with the use of the transmitting-and-receiving circuit 204, obtaining thereby the ID information, that is, the information for identifying ink container, in the read-only area 125. Then, the recording apparatus 300 compares the obtained ID information with the ID information in its storage portion to determine whether or not the two ID information match. If the two do not match, the recording apparatus 300 informs a user of this information. If the two match, the recording apparatus 300 reads the value in the re-writable area 135, which indicates the amount of ink in the ink container 100 by exciting the antenna 231 with the use of transmitting-and-receiving circuit 204, and then, stores the value in the storage portion 203.

The recording apparatus 300 may be controlled so that the head driving portion 209 sends a driving signal to the recording head 200 only after the ink container ID information in the read-only area of the ink container 100 match the ink container ID information in the storage portion of the recording apparatus 300. In this case, the setup may be such that if the ink container ID information in the read-only area of the ink container 100 does not match the ink container ID information in the storage portion of the recording apparatus 300, transmitting-and-receiving circuit 204 does not excite the antenna 221. With the employment of such a setup, it is possible to prevent the recording head 200 from being supplied with a drive signal from the head driving portion 209, making it therefore possible to prevent the problem that a head is damaged by being supplied with ink different from the specific ink for the head.

Further, the recording apparatus 300 may be controlled so that even if the two ink container ID information do not match, the antenna 221 is excited by the transmitting-and-receiving circuit 204 to transmit to the antenna 121, that is, the antenna of the ink container 100, the information that the two ID information do not match. In any case, the recording apparatus 300 is to be controlled so that if the two pieces of ink container ID information do not match, a drive signal is not sent from the head driving portion 209 to the recording head 200.

While recording is made on the recording medium 400, the head driving portion 209 supplies the ink jetting portion 202 of the recording head 200 with ink jetting commands which reflect recording information. The number of times each of the inks different in property (color) has been jetted by the recording head (dot count) is stored in the dot counter 207.

The logic circuit portion 205 calculates the amount of each of the inks different in property (color) which has been used up to the point of calculation, based on the information stored in the storage portion 203, more specifically, the amount of ink jetted per dot and the dot count. Then, it refreshes the value in the storage portion 203 of the recording apparatus 300, which represents the amount of remaining ink.

As soon as the recording on the recording medium 400 ends, the recording head 200 returns to its home position in the recording apparatus 300. While returning to the home position, the recording apparatus 300 changes the value in the re-writable area 135 of each ink container 100, which represents the amount of the remaining ink, to a value, which represents the current amount of the remaining ink, with the use of the transmitting-and-receiving circuit 204.

Figure 7A:
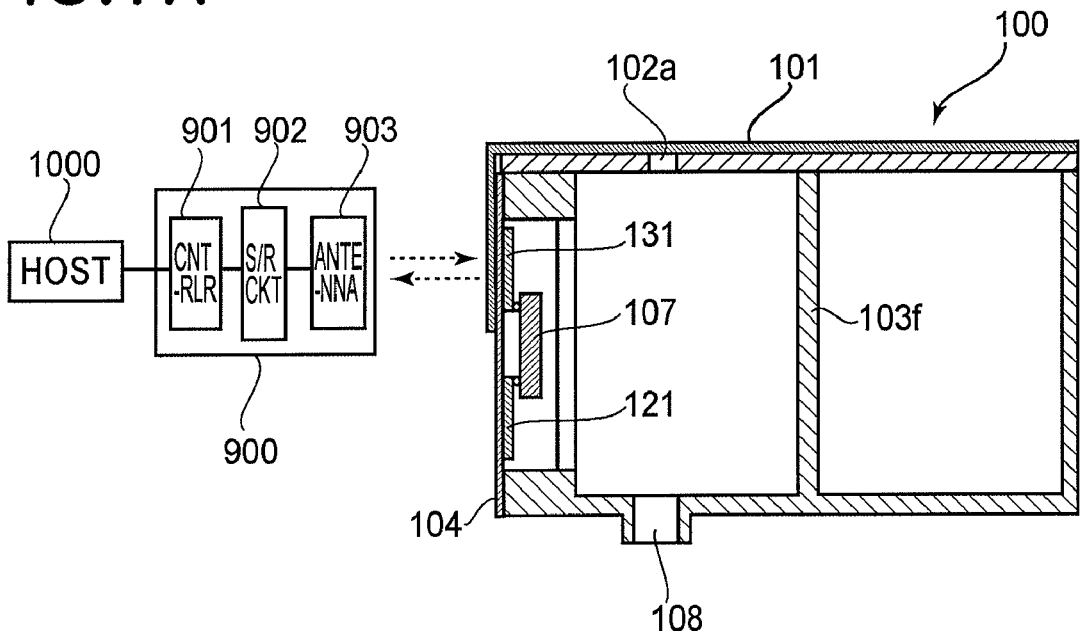
FIG. 7A is a combination of a block diagram of the commodity management system, and a schematic sectional view of the ink container in the preferred embodiment, showing an example of the commodity management process carried out during the distribution of the ink container, in which the re-writable area is not accessed.
Figure 7B:
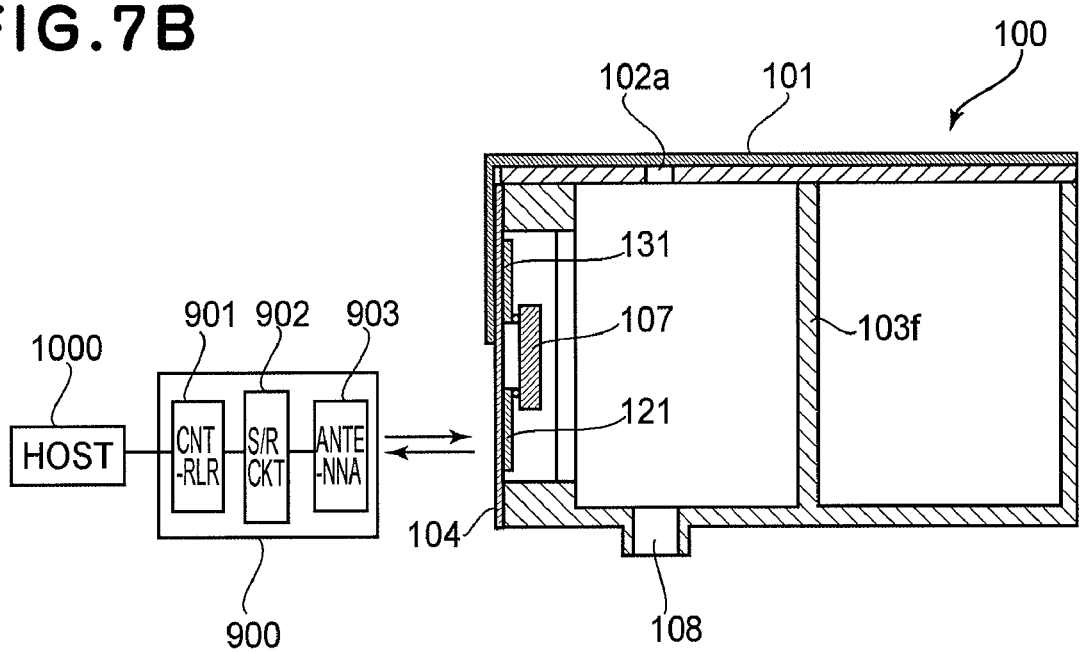
FIG. 7B is a combination of a block diagram of the commodity management system, and a schematic sectional view of the ink container in the preferred embodiment, showing an example of the commodity management process carried out while the ink container is in the main assembly of the recording apparatus, in which the read-only area of the ink container is accessed.
Figure 8:
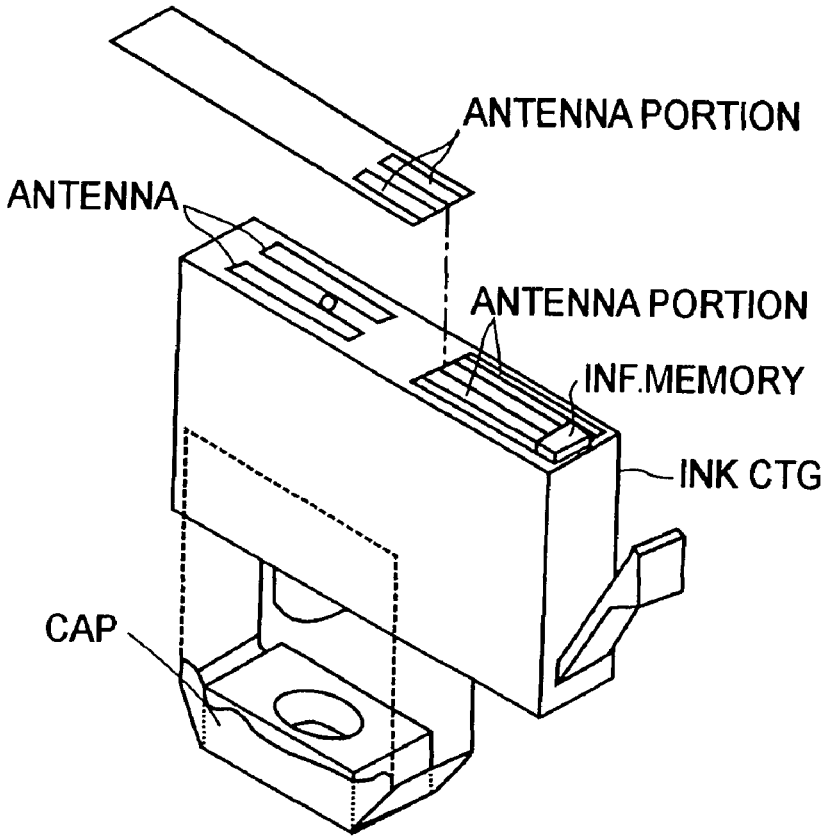
FIG.8 (Prior Art)
FIG. 8 is a perspective view of a conventional ink cartridge provided with an antenna portion and an information storage portion.
Figure 9:
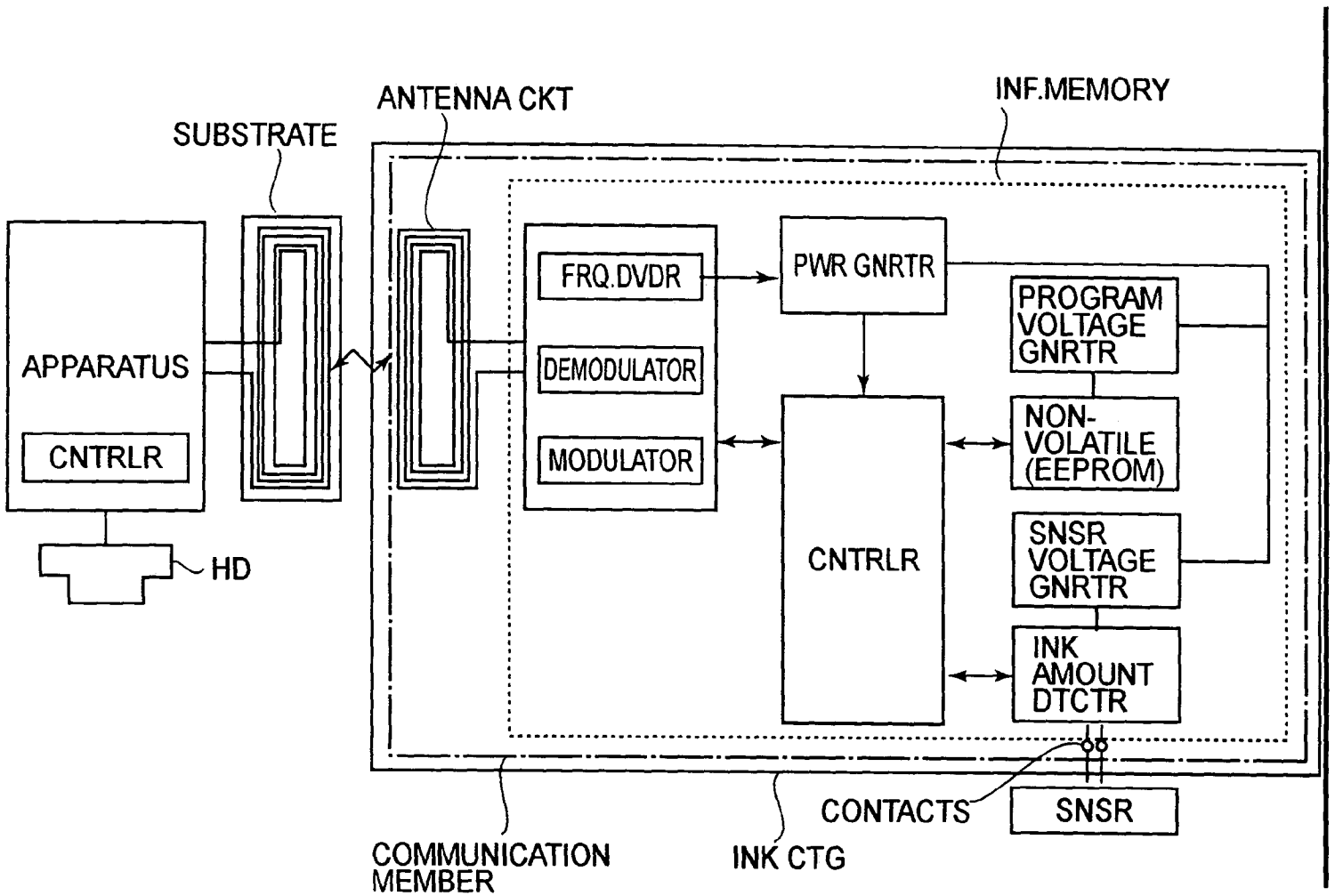
FIG.9 (Prior Art)
FIG. 9 is a circuit diagram of the information storage portion of the conventional ink cartridge having an antenna portion and an information storage portion.

FIGS. 7A and 7B are drawings which show an example of how to manage the inventory of the ink containers in accordance with the present invention during their distribution.

Referring to FIG. 7A, designated by a referential number 1000 is a host computer, which manages the sales count of each item, and also, sends a command for making the control portion 901 of the reading-and-writing apparatus 900 read the data in the memory of each item (ink container), or re-write the data in the memory. The reading-and-writing apparatus 900 has a control portion 901, and a transmitting-and-receiving circuit 902. The transmitting-and-receiving circuit 902 is controlled by the control portion 901 to perform modulation or demodulation. The reading-and-writing apparatus 900 also has an antenna 903, which generates a high frequency magnetic field in response to the high frequency wave signals from the transmitting-and-receiving circuit 902, and in which high frequency signals are induced by the high frequency magnetic field generated by an external source. The reading-and-writing apparatus 900 and host computer 1000 make up a POS (Point of Sale) system. As the data in the memory 110 of the ink container 100, which are read by the POS system, there are the data regarding the information, such as the type of the ink container 100, the trade name of the ink container, etc.

FIG. 7A shows the case in which the antenna 903 of the reading-and-writing apparatus 900 is in the adjacencies of the antenna 131 of the ink container 100. While the ink container 100 is in a distribution network, the antenna 131 of the ink container 100 remains covered with the sealing member 101, which has the metallic foil layer 101*b*. Therefore, the antenna 131 is higher in inductance, making it impossible for the antenna 131 to be excited by the high frequency wave magnetic field generated by the transmitting-and-receiving circuit 902 and antenna 903 of the reading-and-writing apparatus 900. That is, while the ink container is in the distribution network, the reading-and-writing apparatus 900 cannot access the data in the re-writable area of the memory of the ink container 100. Therefore, it does not occur that the data in the re-writable area are accidentally or intentionally altered.

In comparison, FIG. 7B shows the case that the reading-and-writing apparatus 900 is in the adjacencies of the reading antenna 121. In this case, the antenna 121 of the ink container 100, which is dedicated to reading, is not covered with the sealing member 101 provided with the metallic foil layer 101*b*, making it possible for the antenna 121 to be excited by the high frequency wave magnetic field generated by the transmitting-and-receiving circuit 902 and antenna 903 of the reading-and-writing apparatus 900. In other words, in this case, the reading-and-writing apparatus 900 is allowed to access the data in the read-only area 125 of the ink container 100. Therefore, the control portion 901 of the reading-and-writing apparatus 900 can read the ID information in the read-only area 125 of the ink container 100, and can transmit the read information to the host computer 100. While the ink container 100 is in the distribution network in which the reading-and-writing apparatus 900 is used, the air vent 102*a* remains sealed by the sealing member 101, ensuring that the evaporative ingredients of the ink 103*a* do not evaporate, and also, that the ink 103*a* does not leak.

In the preferred embodiment described above, the entirety of the sealing member was uniformly laminar. However, a sealing member which is not uniformly laminar may be employed. For example, the sealing member may be constructed so that the portion of the sealing member, which is for covering the air vent, is provided with two layers, that is, resin film layer and adhesive layer, whereas the portion of the sealing member, which is for blocking magnetic influence, is provided with the resin film layer, metallic foil layer, and adhesive layer. It is possible to make the sealing member so that it has only the metallic foil layer and adhesive layer. In any case, from the standpoint of keeping the ink container in the virgin state, it is desired that the sealing member is constructed so that once the sealing member is peeled from the ink container, it cannot be easily pasted back onto the ink container.

The preceding preferred embodiment was described with reference to the case that the sealing member 101 had both the portion for covering the antenna 131 and the portion for covering the air vent. However, the portion for covering the antenna 131, and the portion for covering the air vent, may be rendered independent from each other. It is needless to say, also in such a case, that the two portions (sealing members) may be rendered different in laminar structure. The separating of the sealing member 101 into two independent sealing members, that is, a sealing member for covering the antenna 131 and a sealing member for covering the air vent, can ensure that the antenna and air vent are satisfactorily covered regardless of the positional relationship between the antenna and air vent, and/or the shape of the ink container. In the case of this modification of the preceding embodiment, however, the operation for peeling the sealing members has to be performed twice, and therefore, this modification sometimes makes slightly more bothersome the operation for preparing the ink container for its first time usage, than the preceding preferred embodiment. In the case of liquid containers which do not require the air vent, and liquid containers provided with means for preventing liquid from leaking out through the air vent, or means for preventing liquid from evaporating through the air vent, all that is necessary is to paste to the antenna portion of the ink container, the sealing member capable of shielding the antenna 131 from the influences which external magnetic fields could exert upon the memory.

Also in the preceding embodiment, the ink container (liquid container) was structured so that it could be removably mountable in the recording head with which the main assembly of the recording apparatus was provided. However, the present invention is also applicable to an ink jet recording cartridge, that is, a cartridge made up of the recording head portion and ink container portion, which is removably mountable in the recording apparatus. Further, the present invention is applicable to ink containers structured so that they can be removably attachable to recording heads which are removably mountable in the recording apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 187001/2006 filed Jul. 6, 2006 which is hereby incorporated by reference.

What is claimed is:

1. A liquid container comprising:

a memory for storing data wherein the memory includes a rewritable region from which the data is readable and in which the data is rewritable, and a read only region from which the data is readable and in which the data is unwritable;

a first circuit for overwriting the data in and for reading the data from said rewritable region;

a first antenna connected with said first circuit;

a second circuit for reading the data from said read only region;

a second antenna connected with said second circuit; and a protecting member for protecting said first antenna and for exposing said second antenna during transportation of said liquid container and for exposing said first antenna and said second antenna in use.

2. A liquid container according to claim 1, wherein each of said first circuit and said second circuit includes a high frequency circuit portion for modulation and demodulation, a control circuit portion for controlling said high frequency circuit portion, and an electric power generation portion for generating electric power for driving said circuit portions in accordance with a high frequency signal supplied from said high frequency circuit portion.

3. A liquid container according to claim 1, wherein a high frequency circuit for said first circuit effects, on the basis of a high frequency signal excited using said first antenna, a control of said high frequency circuit, the reading and overwriting of the data stored in said rewritable region of said memory, the modulation of the read data using said high frequency circuit, and the sending of the data using said first antenna, wherein a high frequency circuit for said second circuit is capable of reading the data from said read-only region of said memory only when said second antenna is excited, and the read data is sent externally through said second antenna.

4. A liquid container according to claim 3, wherein the control of the high frequency circuit is effected by a control circuit portion, and wherein the high frequency signal excited by said first antenna is effective to extract a reference clock signal functioning as an operation reference for said control circuit portion and said high frequency circuit portion itself of said first circuit, and wherein said control circuit portion controls said high frequency circuit portion on the basis of the reference clock signal.

5. A liquid container according to claim 1, wherein the protecting member includes a sealing material comprising a resin material base, a metal foil layer and an adhesive material layer, and wherein said protecting member is removably stuck on an entire area of said first antenna by the adhesive material layer.

6. A liquid container according to claim 1, wherein said liquid container includes an air vent, and wherein said protecting member covers said air vent and said first antenna.

7. A liquid container according to claim 6, wherein said protecting member has layer structures which are different between a portion thereof covering said air vent and a portion thereof covering said first antenna.

8. A liquid container according to claim 1, further comprising a liquid containing portion containing is liquid.

9. A system comprising a recording apparatus and a liquid container, wherein the recording apparatus comprises:

an image forming section which includes a paper transport mechanism for transporting paper to an image formation section, and a carriage-mounted recording head arranged at the image formation station for forming an image on paper transported thereto by ejection of liquid onto the paper, wherein the recording head is constructed to receive the liquid container; and a communication section for non-contact communication with the liquid container;

wherein the liquid container comprises:

a memory for storing data wherein the memory includes a rewritable region from which the data is readable and in which the data is rewritable, and a read only region from which the data is readable and in which the data in unwritable;

a first circuit for overwriting the data in and for reading the data from said rewritable region;

a first antenna connected with said first circuit;

a second circuit for reading the data from said read only region;

a second antenna connected with said second circuit; and a protecting member for protecting said first antenna and for exposing said second antenna during transportation of the liquid container and for exposing said first antenna and said second antenna in use when the liquid container is received by the recording head.

10. A recording apparatus according to claim 9, wherein said read-only region of said memory stores ID information of said liquid container, and only when the ID information matches information relating to a liquid container and stored in said recording apparatus, a driving signal is supplied from a head driver of the recording apparatus to the recording head.

* * * * *